US005210889A

United States Patent [19]

Wesemann et al.

[11] Patent Number: 5,210,889

[45] Date of Patent: May 18, 1993

[54] MATTRESS SUPPORT

[76] Inventors: Rolf Wesemann, Stift 8, 3320 Salzgitter 31; Are Ahrens, Im Winkel 6, 3171 Hillerse; Ruediger Baretti, Kaiserstrasse 54, 4830 Guetersloh, all of Fed. Rep. of Germany

[21] Appl. No.: 838,682

[22] Filed: Feb. 21, 1992

[51] Int. Cl.[5] ..... A47C 23/047; A47C 31/12

[52] U.S. Cl. ..... 5/236.1; 5/241; 5/615

[58] Field of Search ..... 5/236.1, 237, 238, 617, 5/615, 241

[56] References Cited

U.S. PATENT DOCUMENTS

| | | | |
|---|---|---|---|
| 3,717,376 | 2/1973 | Lutchansky | 5/617 |
| 5,060,320 | 10/1991 | Oswald | 5/236.1 |

FOREIGN PATENT DOCUMENTS

| | | | |
|---|---|---|---|
| 0354271 | 2/1990 | European Pat. Off. | 5/236.1 |
| 1260092 | 2/1968 | Fed. Rep. of Germany . | |
| 2832584 | 2/1980 | Fed. Rep. of Germany | 5/236.1 |
| WO89/01749 | 3/1989 | World Int. Prop. O. . | |

*Primary Examiner*—Alexander Grosz
*Attorney, Agent, or Firm*—Foley & Lardner

[57] ABSTRACT

A mattress support in the form of a slatted frame for a bed, having individually mounted support slats which are arranged transversely relative to the lying surface and together form the resting surface for a mattress, for example. To improve its adaptability under loading, the mattress support includes the following features:

a) the lifting element (6) of each support slat (1) is a self-supporting and upright bellows, the air-receiving space of which is constructed to be rigid in its cross-sectional contour and to be variable only in respect of its height and, in its effective length relative to the support slat (1), to be proportional to the associated load;

b) the kinematic coupling (10, 11, 15, 16) consists of a pneumatic coupling which connects all the lifting elements (6) to one another and comprises an air distributor (15, 16) provided with an integrated damping (17, 18, 19), to which air distributor all the bellows are connected via in air connection (11) in each case;

c) each support slat (1) rests directly on its associated bellows via a support slat bearer (5), which bellows is of slightly narrower construction than the support slat bearer (5);

d) each support slat bearer (5) is guided in a forced parallel guide (7, 8, 9) which ensures its parallel displacement relative to itself.

17 Claims, 5 Drawing Sheets

MATTRESS SUPPORT

BACKGROUND OF THE INVENTION

1. Field of the Invention

The invention relates to a mattress support in the form of a slatted frame for a bed, having individually mounted support slats which are arranged transversely relative to the lying surface and together form the resting surface for a mattress, for example, wherein each support slat rests centrally on only one lifting or lowering element (lifting element);

when the resting surface is not loaded, each support slat is in equilibrium, resulting from its weight and a corresponding counter-force, in respect of its height position;

each support slat is displaceable vertically from its position of equilibrium upward or downward within a guide;

all the lifting elements are forcibly connected to one another via a kinematic coupling in such a way that, when only one support slat is loaded, the lowering of said slat from its position of equilibrium by an amount x leads to the lifting of all the other support slats from their position of equilibrium, the sum of all these lifts corresponding approximately to the lowering x in the case of identically dimensioned lifting elements;

2. Description of the Related Art

An embodiment of this type can be seen in DE-AS 1,260,092 (FIG. 1). In this case, the support slats are mounted in a frame so as to be vertically displaceable in vertically extending grooves. Each support slat is fixedly connected in its center to a piston which, in turn, rests on a roller bellows. A shell, extending from the foot end to the head end of the lying surface, bears these roller bellows closely adjacently which guarantee a tight closure of the housing enclosing the medium. Enclosed in the shell is a non-compressible medium, for example water, a container, filled with a compressible medium, for example air, being connected to a branch line, by which means within certain limits a spring mounting is to be achieved on the lying surface. The upper surface of the support slats is covered with foam strips which uninterruptedly cover the entire lying surface and move up and down with the support slats.

In another embodiment disclosed in the prior art document, two bellows are provided for each support slat, which bellows are attached near to the ends of each support slat. The hollow spaces of all the bellows are connected to one another via pipes, a pressure relief valve being connected to this hydraulic system. The bellows are of round construction and have a diameter which is slightly larger than the width of the support slat.

It is also pointed out in the prior art document that the pistons can also be provided with different diameters or with a different active surface so that, for example, the parts of the legs which rest with less force of gravity during use rest on support slats which are subjected to less loading and have pistons with a smaller active surface.

DE-A1-2,832,584 discloses a lying surface consisting of a multiplicity of frame elements arranged in the transverse direction. The frame elements, which are supported by a pressure medium common to all frame elements, can be supported by resilient support elements, which can be mechanical springs or air springs, for the posterior region in addition and parallel to a pressure medium support.

WO 89/01 749 discloses a slatted frame, the slats of which are mounted on the longitudinal frame parts at their ends in the region of the longitudinal frame parts by means of a piston-cylinder arrangement in each case for better balancing of the weight distribution of a human body. For this purpose, the hydraulically or pneumatically acting spaces in the piston-cylinder arrangements are in communication with one another hydraulically or pneumatically.

EP-A2-0,354,271 discloses a slatted frame, in which the slat ends are retained in each case on a resilient device via joints which are formed in each case from a joint pin with a spherical or ellipsoidal joint head and a guide bush, into which the joint head is fitted. In this case, the resilient device of spring-elastic construction consists of an elastic band which is guided over rollers which are arranged rotatably but fixedly on the frame and are arranged on at least both sides of the sites at which the joints are supported.

SUMMARY OF THE INVENTION

The underlying object of the present invention is to improve the mattress support explained at the beginning with respect to its adaptability to loads.

According to the invention, this object is achieved by the following features:

(a) the lifting element of each support slat is a self-supporting and upright bellows, the air receiving space of which is constructed to be rigid in its cross-sectional contour and to be variable only in respect of its height and, in its effective length relative to the support slat, to be proportional to the associated load;

(b) the kinematic coupling consists of a pneumatic coupling which connects all the lifting elements to one another and comprises an air distributor provided with an integrated damping, to which air distributor all the bellows are connected via an air connection in each case;

(c) each support slat rests directly on its associated bellows via a support slat bearer, which bellows is of slightly narrower construction than the support slat bearer;

(d) each support slat bearer is guided in a forced parallel guide which ensures its parallel displacement relative to itself.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

The individual lifting elements can, in principle, be coupled kinematically in any way, that is to say, for example, mechanically, hydraulically, pneumatically and/or magnetically/electromagnetically. However, in order to achieve a height adjustment of the individual support slats which is largely free from static forces, according to the invention a pneumatic, kinematic coupling of the lifting elements is provided.

The bellows provided according to the invention does not require an outer guide with respect to its height adjustment, with the result that in this respect no substantial frictional forces occur either in the height adjustment of the support slat. In order that a change in volume solely causes a change in height of the expanding body, the latter may not permit, for example, lateral bulgings or the like. In a pneumatic, kinematic coupling of this type, the counter-force, which holds the support slats in equilibrium with respect to their height position, is formed by the air pressure of the coupled lifting system multiplied by the effective cross-sectional area of the corresponding lifting element; the damping is $<\infty$. The lifting height of the individual support slats is not technically limited In order to achieve a small dynamic mass transport, that is to say < mass inertia forces, it is advantageous for each support slat to be of largely rigid, but light construction The support slat itself can, in principle, also be of resilient design since it does not affect the coupling principle in the static state. In contrast, the bearer bearing the support slat must be of rigid construction in all cases.

In adaptation to the weight distribution in a human body, provision is made according to the invention for the effective length of the expanding body to be constructed to be proportional to its load. The support slats are therefore supported via their bearer in each case over a more or less long length directly on the centrally arranged bellows so that an only slight change in height of the bellows causes a relatively large change in volume.

In order to prevent a jolting lift of the unloaded support slats in the case of sudden, strong loading of only individual support slats, according to the invention a damping is integrated into the kinematic coupling. By this means, an excessively rapid pressing-in of a suddenly loaded support slat is also avoided. In this case, it is expedient in adaptation to the individual circumstances for this damping to be adjustable.

In order to prevent lateral bulging or the like in the expanding body, it is advantageous for the expanding body to have cross-section stabilizers.

The mattress support according to the invention allows a largely force-free and thus energy-free adaptation to the contour, specifically without using any spring elements.

The lifting element designed according to the invention is of very low construction.

Restorers can be provided for each support slat which rotate the support slat back into its horizontal starting position, seen in the longitudinal axial section, when loading is removed.

Further features of the invention are the subject-matter of the subclaims and are explained in greater detail in conjunction with further advantages of the invention with reference to an exemplary embodiment.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

An embodiment of the invention serving as an example is illustrated in the drawings, in which.

DETAILED DESCRIPTION OF THE PREFERRED EMBODIMENTS

Figure 1:
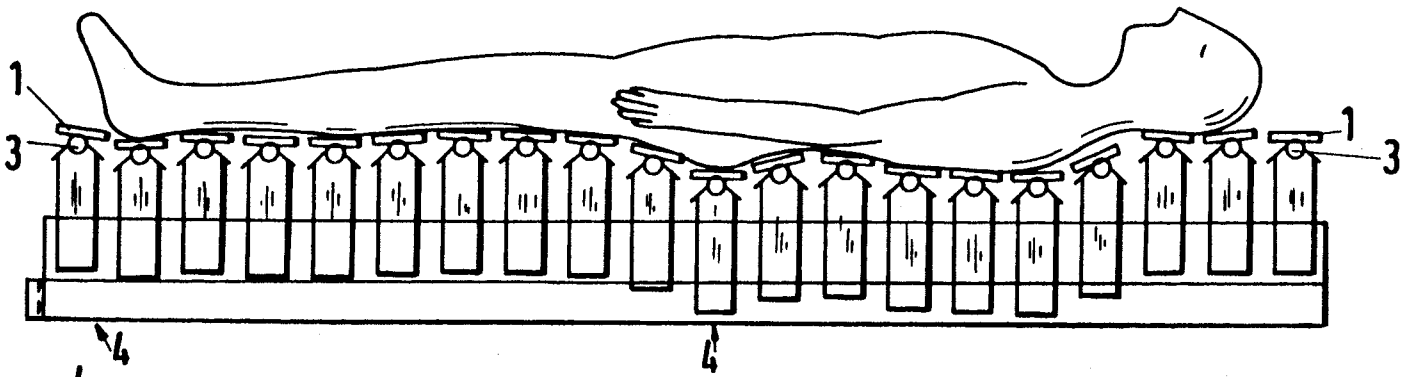
FIG. 1—shows a lateral view in a diagrammatical illustration of a mattress support, loaded by a person lying on his/her back.
Figure 2:
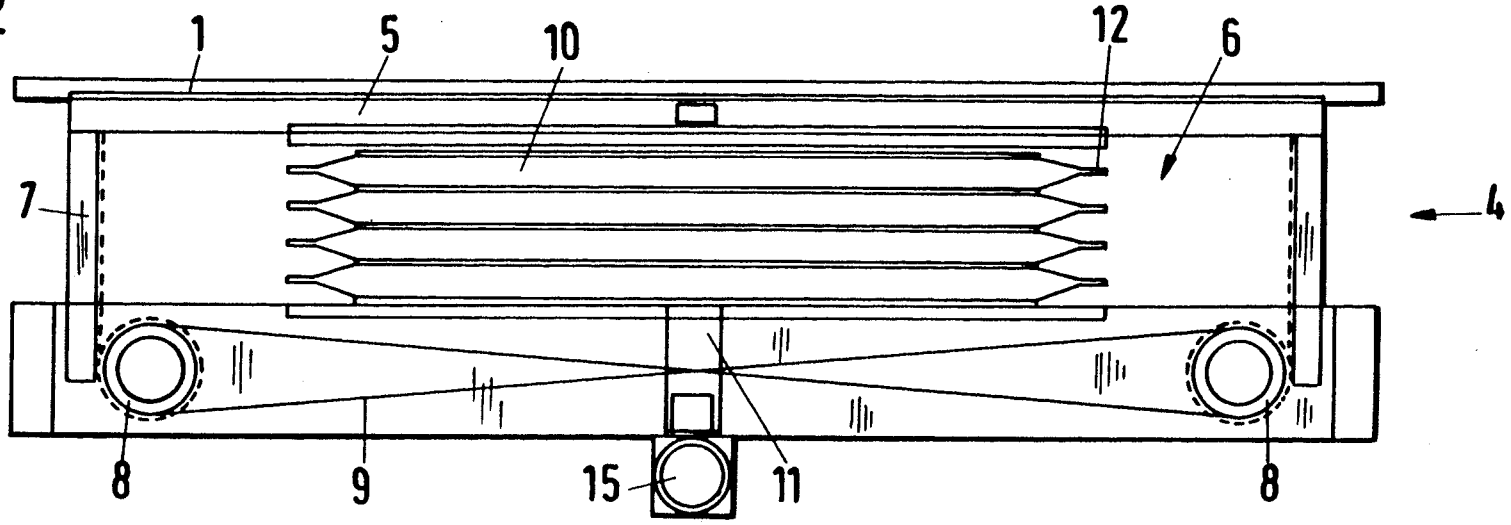
FIG. 2—shows a section of a support slat, raised to its maximum position, on an enlarged scale in relation to FIG. 1.
Figure 3:
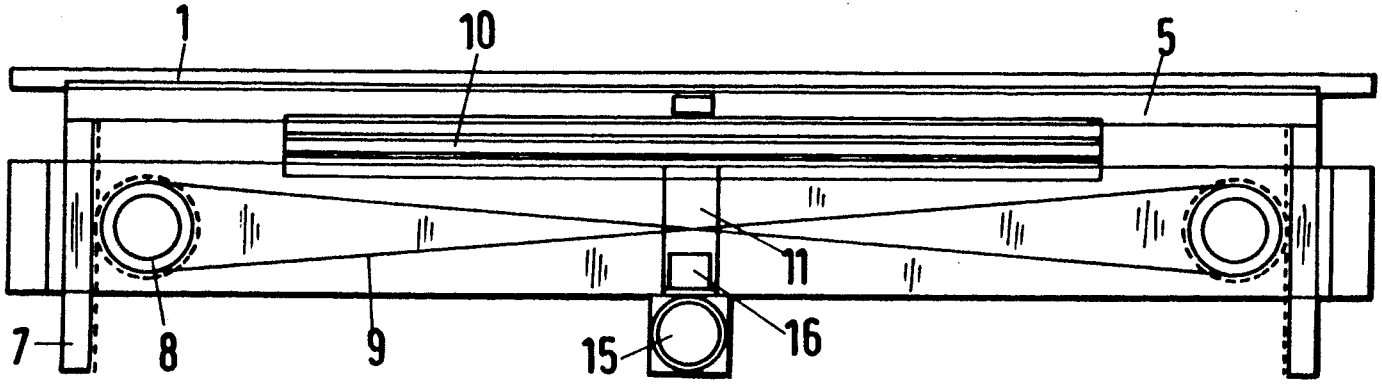
FIG. 3—shows the illustration according to FIG. 2 with the support slat in its lowermost lowered position.
Figure 6:
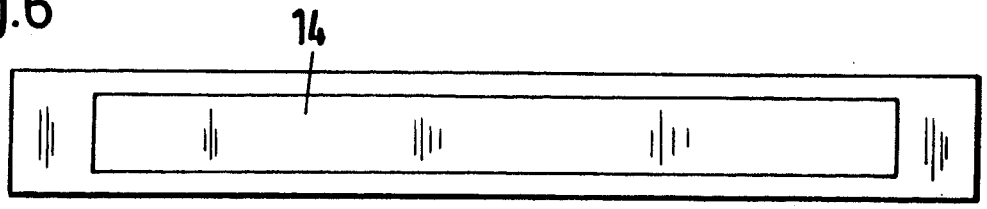
FIG. 6—shows the illustration according to FIG. 4 in a plan view.
Figure 5:
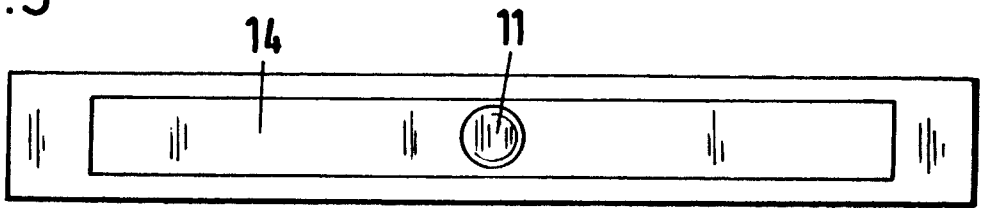
FIG. 5—shows the illustration according to FIG. 4 in a bottom view.
Figure 4:
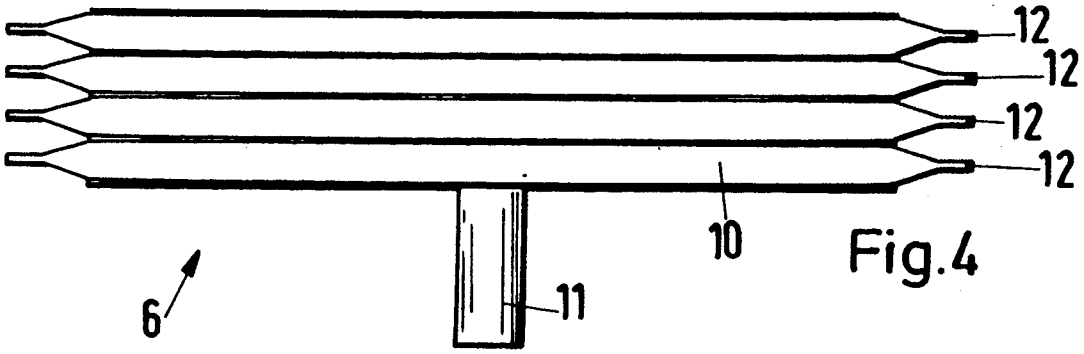
FIG. 4—shows an expanding body, constructed as a bellows, in an illustration according to FIG. 2.
Figure 7:
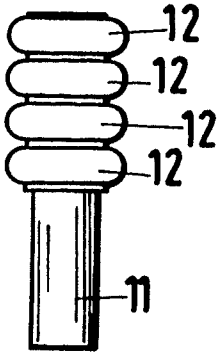
FIG. 7—shows the illustration according to FIG. 4 in a lateral view.
Figure 8:
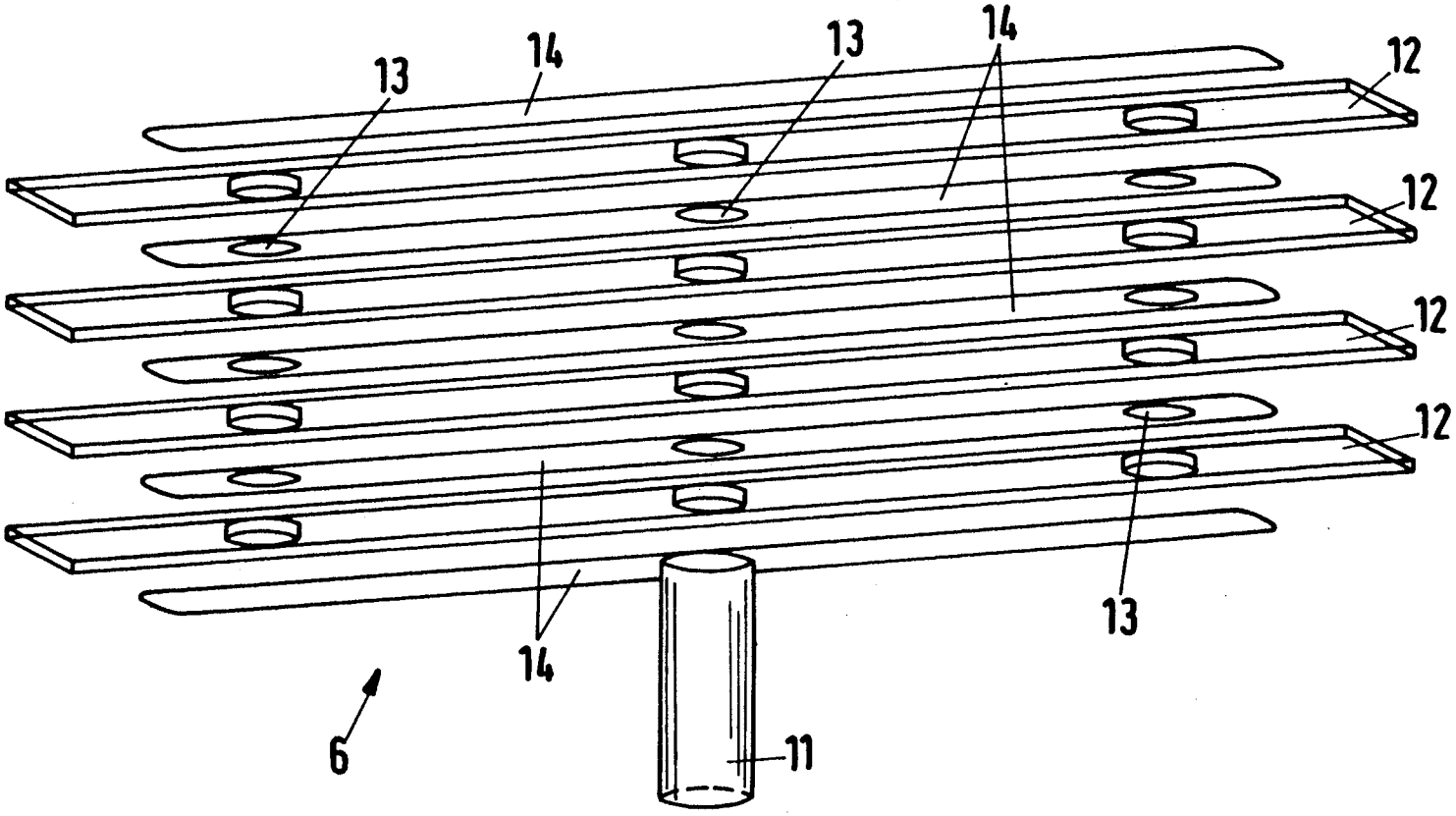
FIG. 8—shows the bellows according to FIG. 4 in an exploded illustration.
Figure 10:
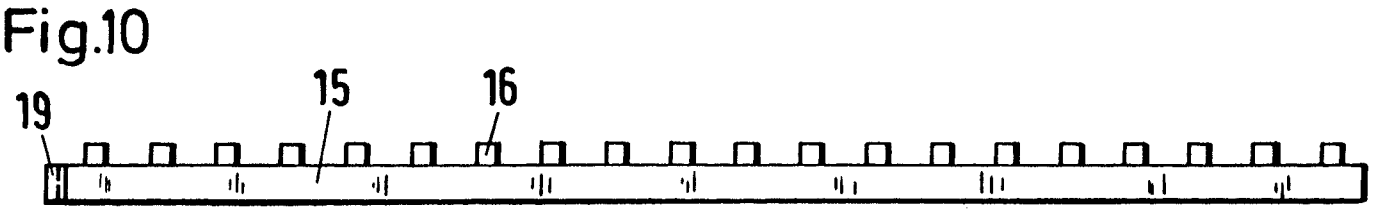
FIG. 10—shows a lateral view of a tubular air distributor.
Figure 11:
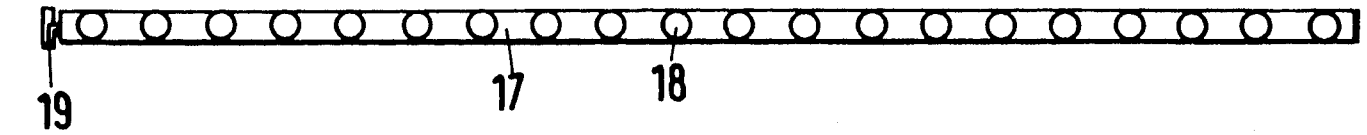
FIG. 11—shows a plan view of an inside pipe of the air distributor according to FIG. 10.

FIG. 1 shows a mattress support in the form of a slatted frame for a bed, having individually mounted support slats 1 which are arranged transversely relative to the lying surface and together form the resting surface for, for example, a mattress. Each support slat 1 can be pivoted freely from its horizontal position, seen in cross section, about an axis of rotation 3, located as close as possible parallel to its longitudinal axis 2 (see FIG. 12), within a limited pivoting range. The mattress support illustrated consists of individual support slat sections 4, one of which is illustrated in FIGS. 2 and 3.

A support slat section 4 comprises a support slat 1, a support slat bearer 5 constructed as a U-shaped bar, a lifting element 6 forming a rest for the support slat bearer 5 and a forced parallel guide for the support slat 1 in its height displacement. This forced parallel guide consists of two downwardly projecting racks 7 which are formed by the two U-limbs of the support slat bearer 5 and which interact in each case with a gear wheel 8 mounted rotatably in the support slat section 4, these two gear wheels 8 being coupled to one another so as to be rotatable in opposite directions via a rope 9 guided in a cross-over manner. It can be seen from the embodiment illustrated that each support slat 1 is of largely rigid construction. In conjunction with the illustrated forced parallel guide 7, 8, 9, it is thus ensured that each pressure loading of the support slat 1, irrespective of its point of action, leads to a vertical parallel displacement of the support slat 1 relative to itself. Tilting of the support slat 1 about a horizontal transverse axis is thus ruled out.

The lifting element 6, inserted in each support slat section 4, is illustrated in greater detail in FIGS. 6 to 9. In the exemplary embodiment, the lifting element 6 comprises an air-filled expanding body 10 with an air connection 11 provided on its underside. The expanding body 10 is an upright bellows, the air-receiving space of which is constructed to be rigid in its cross-sectional contour and to be variable only with respect to its height. Each bellows fold 12 can consist of a hose part which is closed all-round and is connected in each case to the adjacent bellows bold 12 via air exchange channels 13 (see FIG. 8). Furthermore, the expanding body 10 is provided with cross-section stabilizers 14 which consist, for example, of metal foils and can be arranged between the bellows folds 12 and on the upperside and underside of the expanding body 10.

Figure 9:
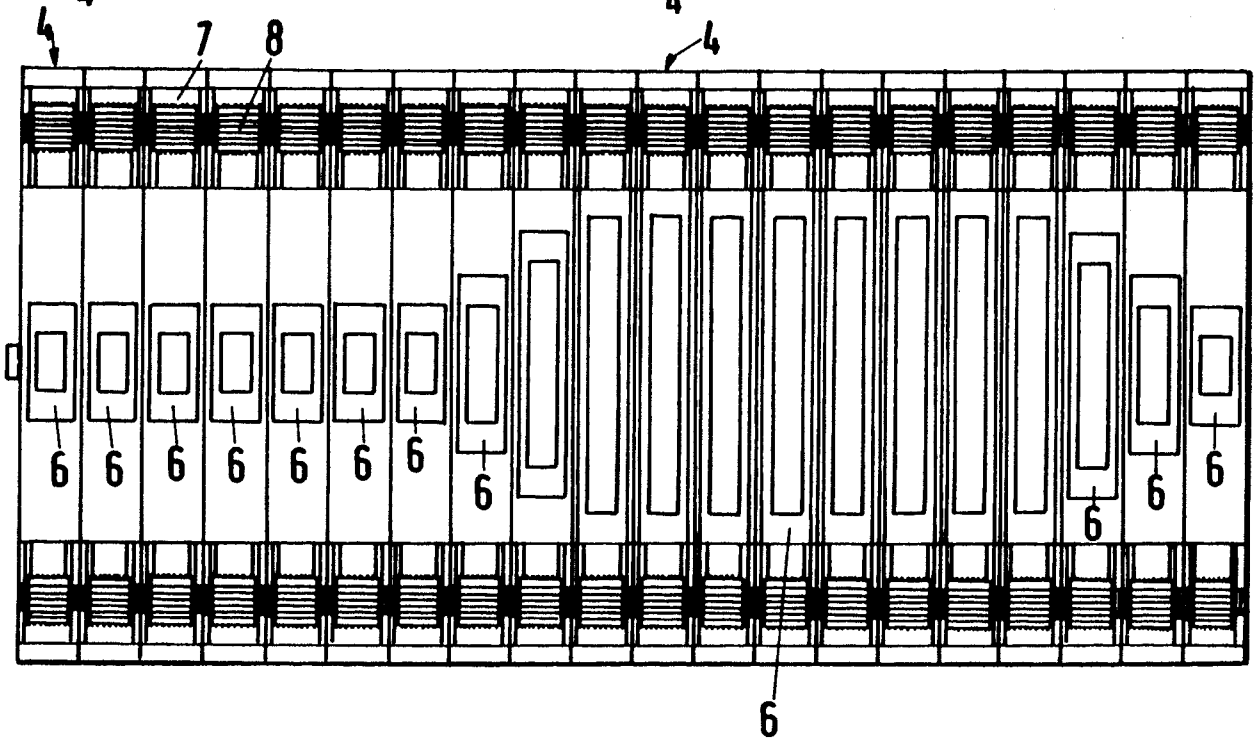
FIG. 9—shows a horizontal section through the mattress support according to FIG. 1.

It can be seen in FIG. 9 that the expanding body 10 is slightly narrower than the associated support slat 1 and is arranged approximately centrally below the latter. In this case, the effective length of the expanding body 10 can be of shorter construction in regions of normally lesser loading. It can be seen from comparing FIG. 9 with FIG. 1 that the shortest expanding body lengths are provided in the head and leg regions.

When the resting surface is not loaded, each support slat 1 is in equilibrium, resulting from its weight and a corresponding counter-force, with respect to its height position. From this position of equilibrium, the support slat 1 can be raised into the highest position illustrated in FIG. 2 or lowered into the lowest position illustrated in FIG. 3. With regard to this lifting and lowering movement, all the lifting elements 6 are forcibly connected to one another via a kinematic coupling in such a way that, when only one support slat 1 is loaded, the lowering of said slat from its position of equilibrium by an amount x leads to the lifting of all the other support slats 1 from their position of equilibrium, the sum of all these lifts corresponding approximately to the lowering x (if the effective length of all the lifting elements is identical). Illustrated as an exemplary embodiment is a pneumatic, kinematic coupling of the support slats 1, consisting essentially of an air distributor, to which all the lifting elements 6 are connected by their air connection 11.

The air distributor is illustrated, in particular, in FIGS. 2, 3, 10 and 11 and it comprises an air distributor pipe 15 which is arranged in the longitudinal direction relative to the lying surface approximately centrally below the latter and has a connection 16 for the air connection 11 of each lifting element 6. A damping, which can be adjusted from the outside, is integrated in the air distributor. The said damping consists of an inside pipe 17 which is inserted concentrically in the air distributor pipe 15, has holes 18 associated with the connections 16 of the air distributor pipe 15 and is rotatable and/or displaceable in relation to the air distributor pipe 15 via a handle 19 at the front end. By relative displacement of the inside pipe 17 in relation to the air distributor pipe 15, a central adjustment of the throttle openings formed between the holes 18 of the inside pipe and the connections 16 of the air distributor pipe 15 thus results, as does a damping which is adjustable and variable from the outside and prevents a jolting lifting of unloaded support slats 1 in the case of sudden, strong loading and thus lower pressing-in of one or more other support slats.

For maintaining the stable equilibrium of all the supports slats or for their virtually force-free adaptation to the outer contour of a body loading the resting surface of the slatted frame, only a slight over-pressure (10–20 mbar) is required in the closed pneumatic system. For filling this system with compressed air, the handle 19 can, for example, comprise a filling valve.

Figure 12:
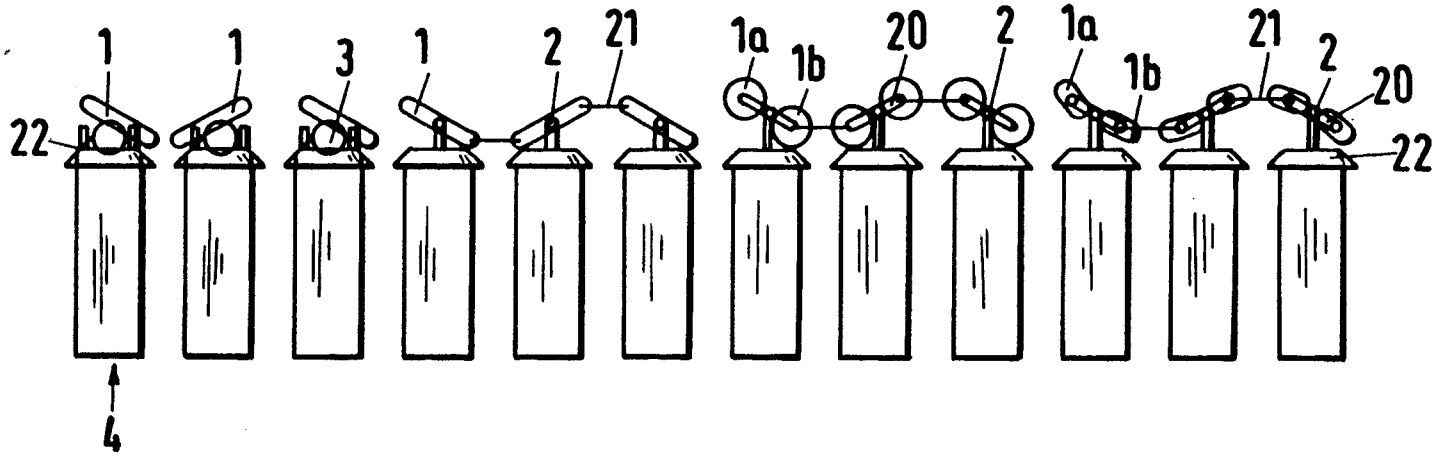
FIG. 12—shows a diagrammatic illustration according to FIG. 1 of support slats of different constructions in different swivel positions.

FIG. 12 shows different exemplary embodiments of the design of the support slats 1 and their bearings.

If the axis of rotation 3 is situated below the actual longitudinal axis 2 of the support slat 1, different clear spacings result between two adjacent support slats when the support slats 1 are pivoted (see the three support slat sections 4 on the left in FIG. 12). This disadvantage is only eliminated if the support slats 1 can be pivoted about their longitudinal axis 2 (see the fourth, fifth and sixth support slat sections from the left in FIG. 12), but this leads to problems in terms of construction since a bearing of this type would require a support slat 1 to be of correspondingly thick dimensions. To avoid this disadvantage, but maintaining the advantage resulting from pivoting about the actual longitudinal axis 2, two alternative proposals are illustrated in FIG. 12 in the six support slat sections illustrated on the right. Both proposals are in conformity to the extent that support slat 1 consists of two individual slats 1*a*, 1*b* which are located adjacently in parallel and are connected to each other via a bearer 20 which is mounted centrally so as to be pivotable between the individual slats. In this case, the individual slats 1*a*, 1*b* can be mounted so as to be rotatable or pivotable on the bearer 20. In one of the two exemplary embodiments, the individual slats 1*a*, 1*b* consist of round rods, whereas in the other example, the individual slats are formed by flattened profiles.

To avoid excessively sharp steps in the contour between two adjacent support slats 1, it can be expedient to connect the adjacent edges of two support slats 1 to one another via a connecting rod 21 which can be formed by a wire. Furthermore, stops 22 limiting the pivoting of the support slats 1 can be provided.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A mattress support comprising:

lifting elements (6);

a forced parallel guide (7, 8, 9);

a kinematic coupling (11, 15, 16); and a slatted frame for a bed, having individually mounted support slats (1) which are arranged transversely relative to a lying surface and together form a resting surface for a mattress, wherein each support slat (1) rests centrally on only one lifting element (6);

at times when the resting surface is not loaded, each support slat (1) is in a position of equilibrium;

each support slat (1) is displaceable vertically from its position of equilibrium upward or downward within the forced parallel guide (7, 8, 9);

all the lifting element (6) are connected to one another via the kinematic coupling (11, 15, 16);

a) the lifting element (6) of each support slat (1) includes a self-supporting and upright bellows (10), having an air-receiving space which is constructed to be rigid in its cross-sectional contour and variable only with respect to its height and, in its effective length relative to the support slat (1), is proportional to an associated load;

b) the kinematic coupling (11, 15, 16) is a pneumatic coupling which connects all the lifting elements (6) to one another and which comprises an air distributor (15, 16) provided with an integrated damping (17, 18, 19), to which air distributor all the bellows (10) are connected via an air connection (11);

c) each support slat (1) rests directly on its associated bellows (10) via a support slat bearer (5), which bellows (10) is of slightly narrower construction than the support slat bearer (5); and d) each support slat bearer (5) is guided in the forced parallel guide (7, 8, 9) which ensures its parallel displacement relative to itself.

2. Mattress support according to claim 1, wherein each bellows (10) includes a plurality of bellows folds (12) and wherein each bellows fold (12) in the bellows (10) is formed by a hose part which is closed all-round and is connected in each case to an adjacent bellows fold (12) via air exchange channels (13).

3. Mattress support according to claim 2, wherein the bellows (10) has cross-section stabilizers (14).

4. Mattress support according to claim 1, wherein the damping (17, 18, 19) is a constriction in the cross-section of the air distributor (15, 16).

5. Mattress support according to claim 4, wherein the damping (17, 18, 19) is adjustable.

6. Mattress support according to claim 1, wherein the air distributor (15, 16) includes an air distributor pipe (15) which is arranged in a longitudinal direction relative to the lying surface, and a connection (16) for each lifting element (6), and wherein the air distributor encloses a concentric inside pipe (17) which has holes (18) associated with the connections (16) of the air distributor pipe (15), which concentric inside pipe (17) is rotatable in relation to the air distributor pipe (15).

7. Mattress support according to claim 1, wherein each support slat (1) is of largely rigid construction.

8. Mattress support according to claim 1, including a plurality of forced parallel guides (7, 8, 9), wherein the forced parallel guide (7, 8, 9) of each support slat bearer (5) has two ends and a downwardly projecting rack (7) on each of the ends, and gear wheels (8) engaged in the rack which gear wheels (8) are coupled to one another so as to be rotatable in opposite directions.

9. Mattress support according to claim 8, wherein the coupling of the gear wheels (8) associated with a support slat bearer (5) is effected via a rope (9) guided in a cross-over manner.

10. Mattress support according to claim 1, wherein each support slat (1) can be pivoted freely from its horizontal position, seen in cross section, about its longitudinal axis (2), within a limited pivoting range in relation to its support slat bearer (5).

11. Mattress support according to claim 10, further comprising a connecting rod (21), wherein adjacent edges of two support slats (1) are connected to one another via the connecting rod (21).

12. Mattress support according to claim 11, wherein the support slat (1) includes a bearer member (20) and two individual slats (1*a*, 1*b*) which are located adjacently in parallel and are connected to each other via the bearer member (20) which is mounted centrally so as to be pivotable between the individual slats (1*a*, 1*b*).

13. Mattress support according to claim 12, wherein the individual slats (1*a*, 1*b*) are mounted so as to be rotatable or pivotable on the bearer member (20).

14. Mattress support according to claim 12, wherein the individual slats (1*a*, 1*b*) are round rods.

15. Mattress support according to claim 10, including stops (22) for limiting the pivoting of the support slat.

16. Mattress support according to claim 6, wherein the concentric inside pipe (17) is displaceable in relation to the air distributor pipe.

17. Mattress support according to claim 1, wherein each support slat (1) can be pivoted freely within a limited pivoting range in relation to its support slat bearer (15), from its horizontal position, seen in cross section, about an axis of rotation (3) located close and parallel to a longitudinal axis (2) of the support slat.

* * * * *